US009346661B2

(12) United States Patent
Veltrop et al.

(10) Patent No.: US 9,346,661 B2
(45) Date of Patent: May 24, 2016

(54) LIQUID DISPENSER WITH STORAGE TANKS

(71) Applicant: Prince Castle LLC, Carol Stream, IL (US)

(72) Inventors: Loren Veltrop, Chicago, IL (US); Christopher Lyons, LaGrange Park, IL (US); Michael A. Graef, Naperville, IL (US)

(73) Assignee: Prince Castle LLC, Carol Stream, IL (US)

( * ) Notice: Subject to any disclaimer, the term of this patent is extended or adjusted under 35 U.S.C. 154(b) by 0 days.

(21) Appl. No.: 14/608,870

(22) Filed: Jan. 29, 2015

(65) Prior Publication Data

US 2015/0136805 A1 May 21, 2015

Related U.S. Application Data

(63) Continuation of application No. 14/470,481, filed on Aug. 27, 2014, now Pat. No. 9,027,791, which is a continuation of application No. 13/169,339, filed on Jun. 27, 2011, now Pat. No. 8,844,768.

(51) Int. Cl.
*B67D 3/00* (2006.01)

(52) U.S. Cl.
CPC ..... *B67D 3/0083* (2013.01); *B67D 3/0067* (2013.01)

(58) Field of Classification Search
CPC ..... B67D 3/0067; B67D 3/0083
USPC ..... 222/143, 512, 132, 144.5, 129, 129.1, 222/146.6, 146.1, 108, 529, 556, 185.1; 220/23.2–23.8, 4.21, 4.26; 206/431
See application file for complete search history.

(56) References Cited

U.S. PATENT DOCUMENTS

| | | | | |
|---|---|---|---|---|
| 2,013,382 | A | 9/1935 | Garwood | |
| 2,560,761 | A | 7/1951 | Ferguson | |
| 2,718,985 | A | 9/1955 | Tamminga | |
| 2,831,610 | A | 4/1958 | Dennie | |
| 3,011,640 | A | 12/1961 | Hoiness | |
| 3,117,695 | A | 1/1964 | Herbert, Jr. | |
| 3,178,064 | A | 4/1965 | Layne | |
| 3,194,426 | A * | 7/1965 | Brown, Jr. | 220/23.4 |

(Continued)

FOREIGN PATENT DOCUMENTS

| | | |
|---|---|---|
| GB | 02398064 | 11/2004 |
| WO | 9425354 | 11/1994 |

(Continued)

OTHER PUBLICATIONS

Cengal et al., Fluid Mechanics, Fundamentals and Applications; Chapter 12: Radiation Process and Properties, McGraw Hill, Higher Education, Copyright 2006.

(Continued)

*Primary Examiner* — Donnell Long
(74) *Attorney, Agent, or Firm* — Andrus Intellectual Property Law, LLP

(57) ABSTRACT

A liquid dispenser has containers, sized, shaped and arranged to enclose different volumes but each of the containers has a top with a refill opening that is substantially the same as the top and openings of the other containers. The containers are provided with curving transition sections that taper the sides of the container to increase or decrease the width of the container to provide a smaller or large top sizes as needed.

18 Claims, 6 Drawing Sheets

(56) References Cited

U.S. PATENT DOCUMENTS

| | | | | | |
|---|---|---|---|---|---|
| 3,212,681 | A | * | 10/1965 | Weikert | 222/183 |
| 3,285,474 | A | * | 11/1966 | Gran | 222/131 |
| 3,368,708 | A | | 2/1968 | Pflederer | |
| 3,539,081 | A | | 11/1970 | Norton et al. | |
| 4,143,795 | A | | 3/1979 | Casebier | |
| 4,316,557 | A | | 2/1982 | Benoun et al. | |
| 4,523,698 | A | | 6/1985 | Kienlein et al. | |
| 4,757,920 | A | | 7/1988 | Harootian, Jr. | |
| 4,759,478 | A | | 7/1988 | Richardson et al. | |
| 4,765,360 | A | | 8/1988 | Baird | |
| 4,784,297 | A | | 11/1988 | Katz | |
| 4,889,255 | A | | 12/1989 | Schiemann | |
| 4,998,647 | A | | 3/1991 | Sharp | |
| 5,105,981 | A | | 4/1992 | Gehman | |
| RE33,943 | E | * | 6/1992 | Arzberger et al. | 62/127 |
| 5,154,917 | A | | 10/1992 | Ibrahim et al. | |
| 5,316,159 | A | | 5/1994 | Douglas et al. | |
| 5,340,211 | A | | 8/1994 | Pratt | |
| 5,490,614 | A | | 2/1996 | Sardynski | |
| 5,492,250 | A | | 2/1996 | Sardynski | |
| 5,535,600 | A | | 7/1996 | Mills | |
| 5,607,072 | A | | 3/1997 | Rigney et al. | |
| 5,673,817 | A | | 10/1997 | Mullen et al. | |
| 5,735,422 | A | | 4/1998 | Binter | |
| 5,740,947 | A | | 4/1998 | Flaig et al. | |
| 5,797,519 | A | | 8/1998 | Schroeder et al. | |
| D404,302 | S | | 1/1999 | Martin | |
| 5,921,440 | A | | 7/1999 | Maines | |
| 6,095,372 | A | | 8/2000 | Dorsey et al. | |
| 6,131,772 | A | | 10/2000 | Robbins et al. | |
| 6,186,361 | B1 | | 2/2001 | Teetsel, III | |
| 6,253,957 | B1 | | 7/2001 | Messerly et al. | |
| 6,325,229 | B1 | | 12/2001 | Anders | |
| 6,497,343 | B1 | | 12/2002 | Teetsel, III | |
| 6,659,311 | B2 | | 12/2003 | Prueter | |
| 6,792,966 | B2 | | 9/2004 | Harvey | |
| 6,951,276 | B2 | | 10/2005 | Danner et al. | |
| D558,604 | S | | 1/2008 | Dohm et al. | |
| 7,337,920 | B2 | | 3/2008 | Ducl et al. | |
| D579,348 | S | | 10/2008 | Piccinino et al. | |
| 7,926,682 | B2 | | 4/2011 | Nelson et al. | |
| 2003/0006247 | A1 | | 1/2003 | Olivier et al. | |
| 2004/0129720 | A1 | | 7/2004 | Cheng et al. | |
| 2004/0134920 | A1 | | 7/2004 | Baron | |
| 2006/0113312 | A2 | | 6/2006 | Shin et al. | |
| 2006/0169720 | A1 | | 8/2006 | Vipond | |
| 2007/0192981 | A1 | | 8/2007 | Lawshe | |
| 2007/0246488 | A1 | | 10/2007 | Cash et al. | |
| 2007/0267378 | A1 | | 11/2007 | Piccinino et al. | |
| 2007/0267446 | A1 | | 11/2007 | Pressler | |
| 2008/0283550 | A1 | | 11/2008 | Nighy et al. | |
| 2009/0250490 | A1 | | 10/2009 | Straza | |
| 2009/0250491 | A1 | | 10/2009 | Erman et al. | |
| 2010/0058931 | A1 | | 3/2010 | Righetti | |
| 2010/0065587 | A1 | | 3/2010 | Erman et al. | |
| 2010/0151083 | A1 | | 6/2010 | Klier et al. | |
| 2011/0042413 | A1 | | 2/2011 | Nighy et al. | |

FOREIGN PATENT DOCUMENTS

| | | |
|---|---|---|
| WO | 0274636 | 9/2002 |
| WO | 03006247 | 1/2003 |
| WO | 2004037595 | 5/2004 |
| WO | 2005030276 | 4/2005 |
| WO | 2008153535 | 12/2008 |
| WO | 2010038047 | 4/2010 |

OTHER PUBLICATIONS

Munson et al., Fundamentals of Fluid Mechanics, Fifth Edition, pp. 112-113, Copyright 2006.

Automatic Products International, Ltd, Hot Beverage Merchandiser Manual, 1994.

Heinz Foodservice, The Heinz Guide to Condiment Dispensing Equipment, 2011.

Pinch Valve Semantics, David Gardellin, President of Onyx Valve Co., available at www.onyxvalve.com, 2011.

Silver King, Cream Dispenser Technical Manual and Replacement Parts List Model SKNES2B/3B, 2011.

Silver King, Majestic Series Milk Dispenser, 2009.

Silver King, Model SKMCD1P, Equipment Manual for McDonald's, 2005.

Silver King, Portion Control Cream Dispensers, 2005.

SureShot Dispensing Systems, Sure Touch Refrigerated Liquid Dispenser Operations Manual, 2011.

SureShot Dispensing Systems, Dairy Dispenser Valve Assembly Cleaning Instructions, 2011.

SureShot, Intellishot, Advanced Portion Controlled Refrigerated Liquid Dispensers, Jan. 2011.

SureShot Dispensing Systems, Suggested Preventive Maintenance Checklist for Refrigerated Liquid Dispenser, Sep. 2006.

SureShot Dispensing Systems, SugarShot Granular Sugar Dispensers Parts Catalogue, 2011.

SureShot, Intellishot Advanced Portion Controlled Refrigerated Liquid Dispensers, Sep. 2007.

SureShot, Flexoshot, Manual Dispense Refrigerated Liquid Dispensers with Optional Illuminated Display, Sep. 2007.

* cited by examiner

LIQUID DISPENSER WITH STORAGE TANKS

CROSS REFERENCE TO RELATED APPLICATION

This application is continuation of U.S. application Ser. No. 14/470,481, filed Aug. 27, 2014, which application was published on Jan. 15, 2015, as U.S. Publication No. US20150014358, which application claims priority to application Ser. No. 13/169,339, filed Jun. 27, 2011, which application was granted on Sep. 30, 2014, as U.S. Pat. No. 8,844,768, which applications are incorporated herein by reference in their entireties.

BACKGROUND

Dispensers for bulk containers of liquid dairy products are well known. Such dispensers are comprised of a refrigerated cabinet in which one or more bulk containers of dairy products are kept cold. The bulk dairy product containers typically have a flexible dispensing tube at the bottom of the container through which product is dispensed using a pinch valve.

Another type of prior art dairy product dispenser uses refillable containers which also have a dispensing tube at the bottom of the container through which dairy product is controllably dispensed using a pinch valve. Prior art refillable containers have top-located openings proportional to their widths.

Many dispensers are designed to be used with two or more refillable containers. Some such dispensers are designed to be used with two or more refillable containers that hold different volumes of liquid. A problem with prior art refillable containers that contain different volumes of liquid is that the openings in the tops of the refillable containers are proportional to the width of the container. When a small-volume container needs to be refilled, the liquid must be poured through an opening that is usually much smaller than the opening in large-volume containers. Refilling small-volume containers is thus more difficult than refilling large-volume containers.

DETAILED DESCRIPTION

Figure 1:
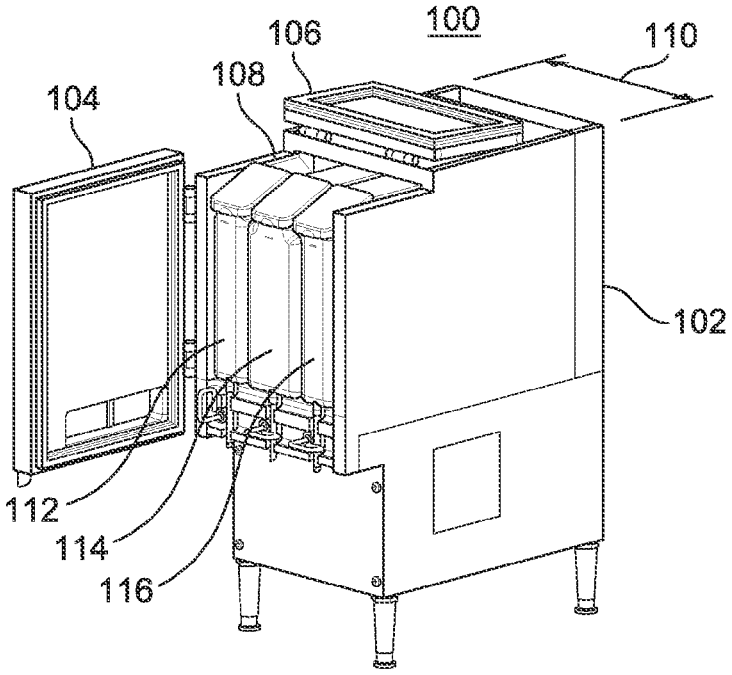
FIG. 1 is a perspective view of a liquid dispenser.

FIG. 1 is a perspective view of a liquid dispenser 100. The dispenser 100 is comprised of a refrigerated cabinet having a front door 104, a top access panel 106 and a refrigerated interior compartment 108 having a width 110 to accommodate three separate liquid containers 112, 114 and 116.

Figure 2:
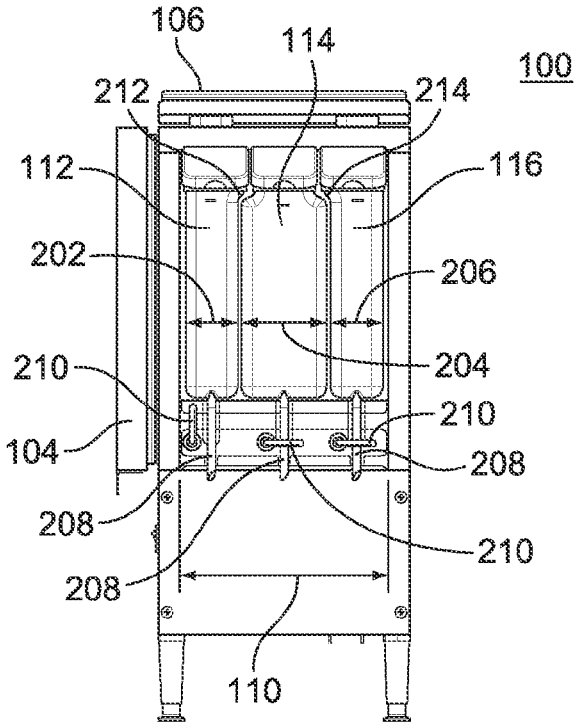
FIG. 2 is a front elevation view of the liquid dispenser.

FIG. 2 is a front elevation view of the liquid dispenser 100. A first container 112 is positioned to the left side of a center container 114. A right side container 116 is positioned to the right side of the center container 114. The left side container

112 has a width 202; the center container 114 has a larger width 204. The right side container 116 has a width identified by reference numeral 206. The combined widths 202, 204 and 206 fit within the width 110 of the refrigerated compartment 108. Each of the containers 112, 114 and 116 has a dispensing tube 208 that extends downwardly from the container through a pinch bar of a pinch valve 210.

One example of a pinch bar and pinch valve is disclosed in the applicants co-pending patent application Ser. No. 12/885,641, filed Sep. 20, 2010, issued Feb. 19, 2013 as U.S. Pat. No. 8,376,310 and entitled Pinch Valve. The content of said application is incorporated in its entirety herein by reference.

Another example of a pinch bar and pinch valve is co-pending patent application Ser. No. 13/169,305, filed Jun. 27, 2011, issued Sep. 30, 2014 as U.S. Pat. No. 8,844,768 and is entitled Liquid Dispenser Pinch Valve. The content of said application is also incorporated in its entirety herein by reference.

Figure 3A:
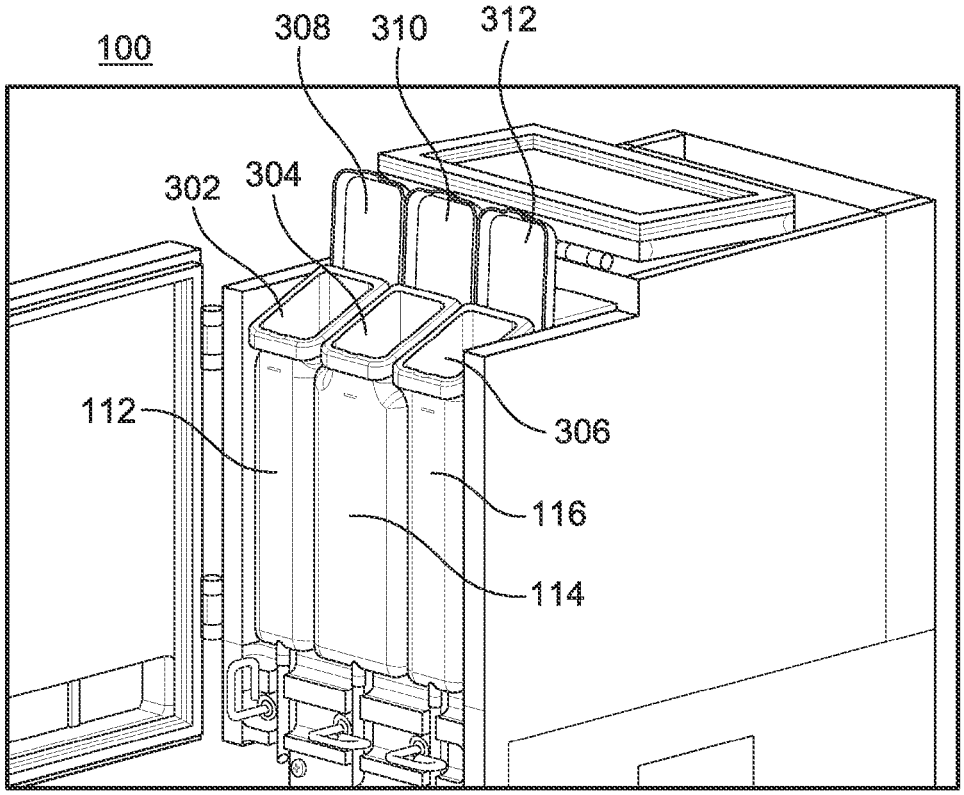
FIG. 3A is a perspective view of the liquid dispenser showing the containers with openings.

FIG. 3A is a perspective view of the liquid dispenser 100 showing the left container 112, the center container 114, and the right container 116 with openings 302, 304 and 306 in the top of the containers. Each opening 302, 304 and 306 is provided with a corresponding cover 308, 310 and 312.

Figure 3B:
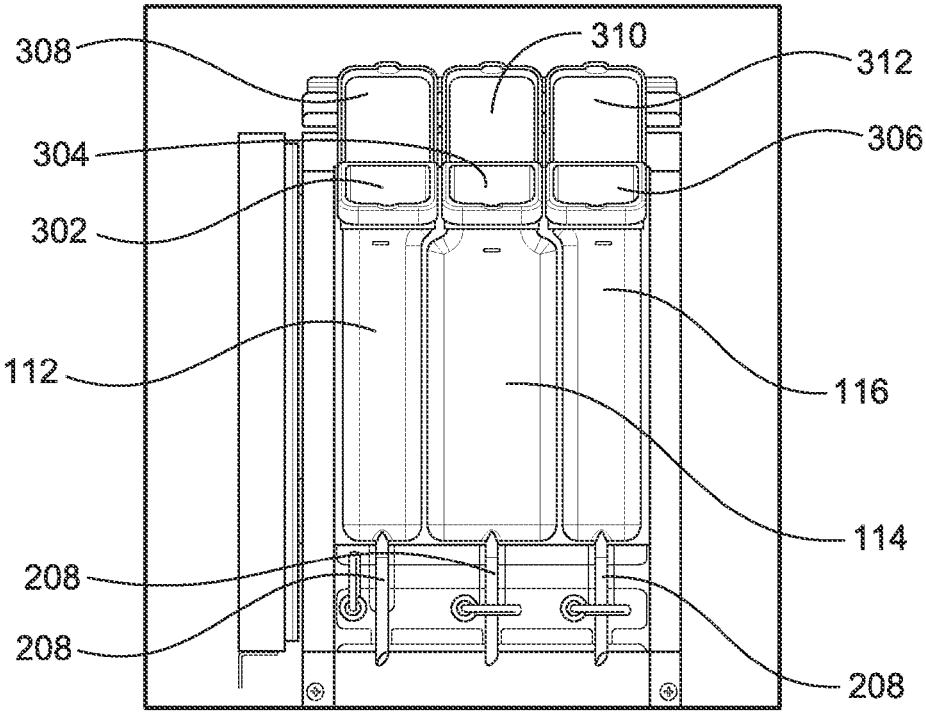
FIG. 3B is a front elevation view of the liquid dispenser.

FIG. 3B is a front elevation view of the liquid dispenser 100 also showing the containers 112, 114, and 116 along with the dispensing tubes 208. The covers 308, 310, and 312 are open to reveal openings 302, 304, and 306.

Figure 4:
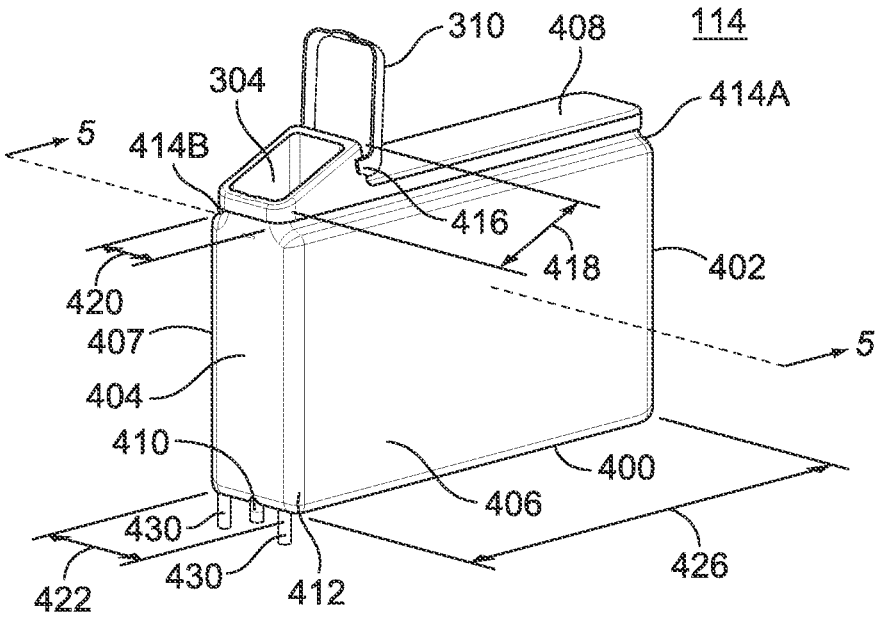
FIG. 4 is a perspective view of the center container.

FIG. 4 is a perspective view of the center container 114. The center container 114 is one of three containers sized, shaped and arranged to fit within the width 110 of the refrigerated interior compartment 108 of the dispenser 100. The center or middle container 114 can be seen in FIG. 4 as having a shape substantially the same as a rectangular parallelepiped or cuboid. A parallelepiped is a six-faced polyhedron all of the faces of which are parallelograms and lying in pairs of parallel planes.

The center container 114 has a bottom wall or surface 400, a back side or wall 402, a front side or face 404, a right side 406, an opposing left side 407, and a top 408. A small cylinder 410 can be seen projecting downwardly from the bottom 400. The cylinder 410 is a drain for the container 114. Liquid stored in the container 114 flows through the cylinder 410 into a dispensing tube 208 into which the cylinder 410 is inserted. The cylinder 410, which is preferably formed of the same material as the container 114, is protected from breakage by two legs 430 that extend downwardly from the bottom 400 of the container 114.

Except for the top 408, the container 114 is molded. The corners 412 are thus rounded imbuing the side walls 402, 404, 406 and 407 with an uninterrupted connection or union between them. The rounded corners 412 and the side walls 402, 404, 406 and 407 can thus be considered as a continuous side wall or as four separate side walls separated by the rounded corners 412.

The top 408 has incorporated within it the aforementioned opening 304 and a cover 310. The cover 310 is hinged 416 to the top 408 by winch the cover 310 can be rotated around the hinge 416 between an opened and closed position.

The opening 304 has a width 420 and a length or depth 418. The product of the depth 418 and the width 420 is substantially equal to the open area through which a liquid can be poured into the container 114 to refill it.

As used herein, the term, "substantially equal" means that in one embodiment, a cover for one opening will fit the other openings with a fit or seal, the tightness of which is substantially the same between them, regardless of the container volumes. In another embodiment, "substantially equal"

means that the areas of the openings in the different containers vary by less than about ten percent (10%) regardless of the container volumes. Stated another way, one opening in one container is not more than ten percent larger or smaller than another opening in another container. In another embodiment, "substantially equal" means that the areas of the openings vary by less than about twenty percent (20%) regardless of the container volumes. One opening in one container is not more than twenty percent larger or smaller than another opening in another container. In yet another embodiment, the openings are "substantially equal" if the areas of the openings vary by less than about thirty percent (30%) regardless of the container volumes.

The container 114 has a width 422 defined herein as the separation distance between the right side 406 and the left side 407. In the embodiment shown, the right side 406 and the left side 407 are both substantially vertical and parallel to each other almost completely from the bottom 400 to the top 408. The width is identified in FIG. 4 by reference numeral 422. It can be seen that the width 420 of the opening 304 is less than the width 422 of the container itself 114. The reduced width 420 of the opening 304 is due in part to an arcuate, by which is meant, curved like a bow, or an otherwise curving transition section 414A and 414B on the right side 406 and the left side 407. The transition sections or transition portions reduce the width of the container 114 from its nominal width identified by reference numeral 422 to the width 420 of the opening 304. The transition sections 414A and 414B of the middle container 114 thus reduce the width dimension 422 of the container at or near the top of the container 114 because the transition sections or portions are complementary to each other.

The transition sections 414A and 414B are considered herein to be complementary because they are shaped to be mirror images of each other. By way of example, the right side transition section 414A has a curvature that transitions or moves the right side wall 406 inwardly or toward the left side wall 407. The left side transition portion 414B has a curvature that moves or transitions the left side of the tank 407 inwardly or toward the right side 406. The right side transition section 414A and the left side transition section 414B move the respective sides an equal distance inwardly. The transition sections are thus considered to be complements of each other.

Figure 5:
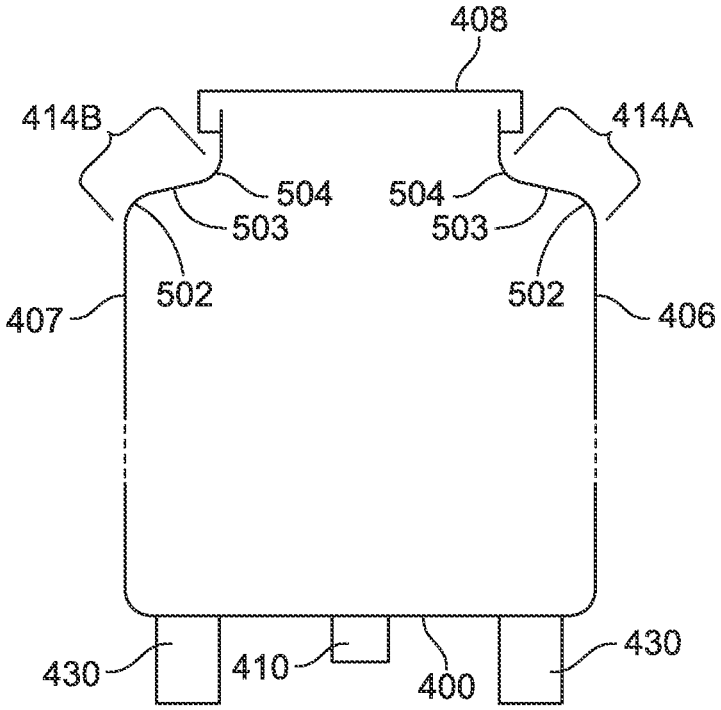
FIG. 5 is a cross section of the center tank taken through section line 5-5.

FIG. 5 is a cross section of the center tank 114 taken through section lines 5-5. The transition sections 414A and 414B have inwardly curving sections 502 relatively straight intermediate sections 503 and outwardly curving sections 504. The transition sections 414A and 414B thus have a cross-sectional shaped serpentine in nature or boustrophedonic.

Figure 6:
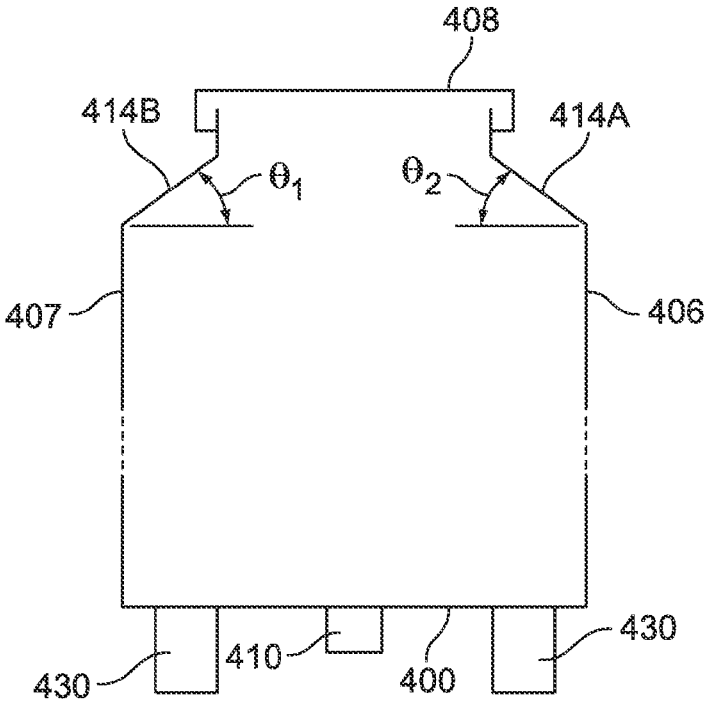
FIG. 6 is a cross section showing an alternative embodiment of the center tank taken through section line 5-5.

FIG. 6 is another cross-sectional view of the middle container 114 taken through section lines 5-5, but showing an alternate embodiment of the transition sections 414A and 414B. In FIG. 6, the transition sections are depicted as substantially straight lines inclined at angles 81 and 82 relative to horizontal. The relatively straight transition portions 414A and 414B are thus considered to be angular in shape, the term "angular" meaning forming an angle.

Figure 7:
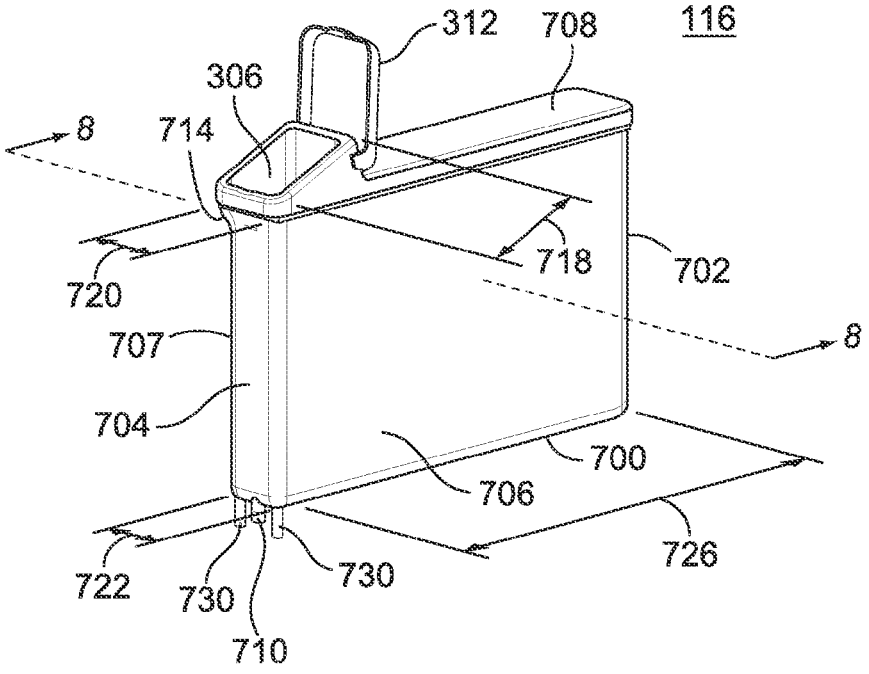
FIG. 7 is a perspective view of the right side container.

FIG. 7 is a perspective view of the right-side container 116. The container 116 has bottom 700, a rear side or face 702, a front side or face 704, a right side 706, a left side 707 and lop 708. The cylinder 710 is a drain for the right side container 116. As with the center container 114, liquid stored in the right-side container 116 flows through the cylinder 710 into a dispensing tube 208 into which the cylinder 710 is inserted. The cylinder 710, which is preferably formed of the same material as the container 116, is protected from breakage by two legs 730 that extend downwardly from the bottom 700 of the container 116.

The container 116 has width measured just above the bottom 700 that is identified by reference numeral 722. A width at the top 708 is identified by reference numeral 720. As shown in the figure, the top width 720 is significantly greater than the bottom width 722. The increased width at the top 720 over the bottom 722 is due to a transition portion identified by 714. The transition portion 714 of the right side tank 116 increases the width of the container to be substantially equal to the width 420 at the top 408 of the middle container 114.

Figure 8:
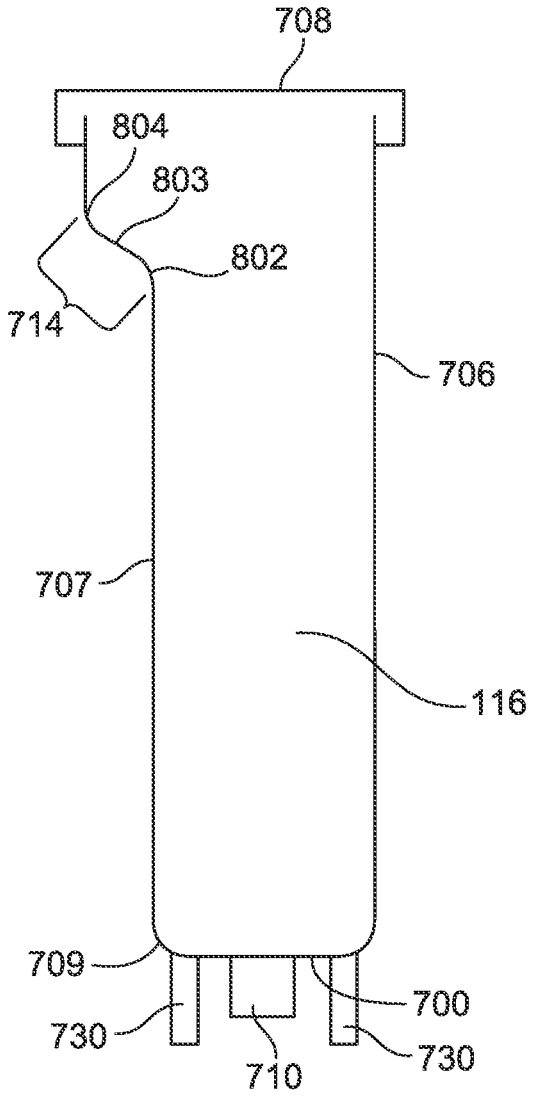
FIG. 8 is a cross section view of the right side container taken through section line 8-8.

FIG. 8 is cross-sectional view of the right side container 116 taken through section lines 8-8. The transition portion 714 has an outwardly curving section 802 connected to a substantially straight intermediate section 803, which is followed by or connected to an inwardly curving section 804. The transition section 714 for the right hand side container 116 can thus also be characterized as serpentine or boustrophedonic.

Referring again to FIG. 7, it can be seen that the opening 306 and the top 708 also has an area determined by the product of the depth 718 by the width 720. As shown in FIG. 1, FIG. 2, and FIG. 3A, the area of the openings in both the center and right-hand side containers 114 and 116, respectively, are the same which is due to the fact that the transition areas for the middle container 114 squeeze or reduce the width of that container while the transition section 714 of the right-hand container 116 enlarges or increases the width 722 of the right-hand container 116. It can also be seen that the depth 726 of the right-hand container 116 is substantially equal to the depth 426 of the center container 114. The top portions of both containers are thus substantially equal in as much as the width of the top 408 of the center container 114 is substantially equal to the width 720 of the top 708 of the right-hand container 116.

Figure 9:
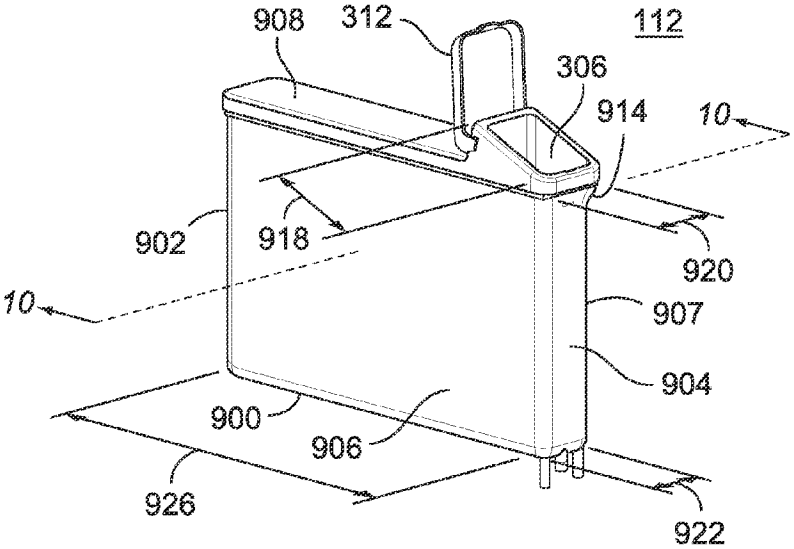
FIG. 9 is a perspective view of the left side container.

FIG. 9 is a perspective view of the left-side container 112. The container 112 has a bottom 900, a rear side or face 902, a front side or face 904, a right side 906, a left side 907 and top 908. The container 112 has width measured just above the bottom 900 that is identified by reference numeral 922. A width at the top 908 is identified by reference numeral 920. As shown in the figure, the top width 920 is greater than the bottom width 922. This is a similar situation as occurs with the right side container. The increased width of the left side container at the top 920 over the bottom 922 is due to a transition portion identified by 914. The transition portion 914 of the left side tank 112 increases the width of the container to be substantially equal to the width 420 at the top 408 of the middle container 114.

Figure 10:
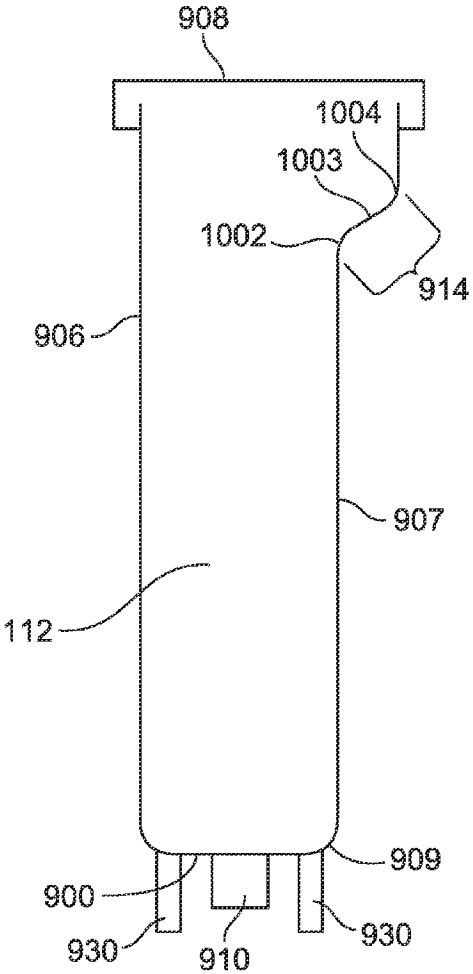
FIG. 10 is a cross section view of the left side container taken through section line 10-10.

FIG. 10 is cross-sectional view of the left side container 112 taken through section lines 10-10. The cylinder 910 is a drain for the right side container 112. As with the center container 114 and the right-side container 116, liquid stored in the left-side container 112 flows through the cylinder 910 into a dispensing tube 208 into which the cylinder 910 is inserted. The cylinder 910, which is preferably formed of the same material as the container 112, is protected from breakage by two legs 930 that extend downwardly from the bottom 900 of the container 112.

The transition portion 914 has an outwardly curving section 1002 connected to a substantially straight intermediate section 1003, which is followed by or connected to an inwardly curving section 1004. The transition section 914 for the left hand side container 112 can thus also be characterized as serpentine or boustrophedonic.

Referring again to FIG. 9, it can be seen that the opening 306 and the top 908 also has an area determined by the product of the depth 918 by the width 920. As shown in FIG. 1, FIG. 2, and FIG. 3A, the area of the openings in both the center and left-hand side containers 114 and 112, respectively, are the same which is due to the fact that the transition areas for the middle container 114 squeeze or reduce the width of that container while the transition section 914 of the left-hand container 112 enlarges or increases the width 922 of the left-hand container 112. Again, this situation is similar concerning the right-side container. It can also be seen that the depth 926 of the left-hand container 112 is substantially equal to the depth 426 of the center container 114. The top portions of both containers are thus substantially equal in as much as the width of the top 408 of the center container 114 is substantially equal to the width 920 of the top 908 of the left-hand container 112.

The left side container 112 is a mirror image of the right-side container 116. Stated another way, the left-side container 112 has a width 202 near its bottom that is increased or enlarged by a transition section 212 that is a mirror image of the transition section 214 for the right-side container 116. The left-side container 112 can thus be considered a third container. It has a top portion with a width substantially equal to the top portion width of the first container 116. Similarly the left-side container 112 has a bottom having a width substantially equal to the bottom of the right-side container 116. The left side container 112 has opposing side walls and front and back walls all four of which are attached to the bottom and which extend upwardly to the top.

All three containers 112, 114 and 116 have input inlets or ports described above and identified by reference numeral 302, 304, and 306 the shape and areas of which are substantially identical. As best seen in FIG. 3A, those inlet ports are inclined at an angle relative to horizontal to facilitate refilling, the containers. In a preferred embodiment, the inlet ports 302, 304 and 306 are inclined at the same angle. However, alternate embodiments include inclining those inlet ports at different angles relative to each other.

Configuring, the tanks and input ports 302, 304 and 306 to have the shape as shown is contrary to common sense and non-obvious for at least two reasons. First, molding or assembling the tanks to have transition sections adds cost. Second, as can be seen in FIGS. 8 and 8, when the containers 112, 114 and 116 are removed from the compartment 108, the left-side container 112 and the right-side container 116 are made somewhat unstable by their enlarged openings. The enlarged input ports 302 and 306 for the left-hand container 112 and the righthand container 116 extend sideways outside or beyond the foot prints 700 and 900 of the bottom of the containers. If the left-hand container 112 or the right-hand container 116 is refilled outside the compartment 108, pouring a liquid into one of the input ports 302 and 306 can create a downward force on transition sections 714 and 914 that creates a torque around the corresponding inside edges 709 and 909 of the bottoms of the containers, which will tend to tip the containers over thus rendering them somewhat difficult to use. When the containers are inside the compartment 108 however, they are held together as an assembly, which prevents either one of them from tipping over during refilling.

Those of ordinary skill in the art will recognize that the transition sections 414A and 414B on the middle container 114 opened downwardly, which is to say the portions of the transition sections closest to the top 408 are closer to each other than the portions of the transition sections that are attached to or connected to the side walls 406 and 407. The transition section 714 for the right-side container 116 and the mirror image transition section 914 for the left-side container 112 open upwardly, which is to say the top section of the right-side tank 708 is wider than the bottom section. In addition, the top section of the left-side tank 908 is also wider than the bottom section.

Those of ordinary skill in the art will also recognize from FIG. 1, FIG. 2, FIG. 3A, and FIG. 3B that the transition section 714 and its adjacent transition section 414A are complements of each other. The transition section 714 on the right-side container 116 transitions the left-side side wall 707 outwardly, whereas the right-hand transition section 414A of the middle container 114 transitions the side wall 406 inwardly. Similarly, the transition section 914 on the left-side container 112 transitions the right-side wall, outwardly, whereas the left-hand transition section 414B of the middle container 114 transitions the side wall 407 inwardly.

In one embodiment, the covers 308, 310 and 312 are pivotally attached to the top covers. However, in an alternate embodiment the covers 308, 310 and 312 can be pivotally attached to the side walls of the containers.

The foregoing description is for purposes of illustration only. The true scope of the invention is set forth in the appurtenant claims.

What is claimed is:

1. A liquid dispenser comprising:

a first container having a first volume, the first container comprising a first bottom, a first back wall, a first front wall, a first side wall, and a second side wall, a first container width defined between the first side wall and the second side wall, the first container comprising a first top defined between a first top edge and a second top edge, the first top edge generally in vertical alignment with the first side wall, the second top edge located away from the second side wall in a direction away from the first side wall, and a first top opening width defined between the first top edge and the second top edge;

a first drain extending downwardly from the first bottom; and a cabinet having a interior compartment, the interior compartment having an interior width, the first container disposed within the interior compartment of the cabinet;

wherein the first top opening width is greater than the first container width and the first top opening is configured to receive liquid into the first container to fill the first container while at least a portion of the first container is retained within the interior compartment and the first drain is configured to dispense liquid from the first container while at least a portion of the first container is retained within the interior compartment.

2. The liquid dispenser of claim 1, comprising a first transition section extending between the second side wall and the second top edge the first transition section extending in a direction generally away from the first side wall.

3. A liquid dispenser comprising:

a cabinet having an interior compartment, the interior compartment having an interior width;

a first container disposed within the interior compartment and having a first volume, the first container comprising a first bottom, a first back wall, a first front wall, a first side wall, and a second side wall, a first container width defined between the first side wall and the second side wall, the first container comprising a first top having a first top edge and a second top edge, a first top opening width defined between the first top edge and the second top edge; and a second container disposed within the interior compartment and having a second volume, the second container comprising a second bottom, a second back wall, a second front wall, a third side wall, and a fourth side wall, a second container width defined between the third side wall and the second side wall, the second container comprising a second top having a third top edge and a fourth top edge, a second top opening width defined between the first top edge and the second top edge;

wherein the second top edge is located away from the second side wall in a direction away from the first side wall, and the third top edge is located away from the third side wall in a direction towards the fourth side wall.

4. The liquid dispenser of claim 3, wherein the second container width is greater than the first container width, the first top opening width is greater than the first container width, and the second top opening width is less than the second container width.

5. The liquid dispenser of claim 4, wherein the first top opening width is substantially equal to the second top opening width.

6. The liquid dispenser of claim 3, wherein the first top opening is configured to receive liquid into the first container to fill the first container while at least a portion of the first container is retained within the interior compartment and the second top opening is configured to receive liquid into the second container to fill the second container while at least a portion of the second container is retained within the interior compartment.

7. The liquid dispenser of claim 3, wherein the second top edge is located away from the third wall in a direction towards the fourth wall.

8. The liquid dispenser of claim 3, further comprising:

a third container disposed within the interior compartment and having a third volume, third container comprising a third bottom, a third back wall, a third front wall, a fifth side wall, and a sixth side wall, a third container width defined between the fifth side wall and the sixth side wall, the third container comprising a third top having a fifth top edge and a sixth top edge, a third top opening width defined between the fifth top edge and the sixth top edge;

wherein the fourth top edge is located away from the fourth side wall in a direction towards the third side wall and the fifth top edge is located away from the fifth side wall in a direction away from the sixth side wall.

9. The liquid dispenser of claim 8, wherein a summed width of the first container width, second container width, and the third container width is substantially equal to the interior width.

10. The liquid dispenser of claim 8, wherein the first volume is substantially equal to the third volume.

11. A liquid dispenser comprising:

a first container having a first volume, the first container comprising a first bottom, a first back wall, a first front wall, a first side wall terminating in a first top edge, and a second side wall terminating in a second top edge, the second top edge located away from the second side wall in a direction away from the first side wall, a first container width defined between the first side wall and the second side wall, and a first top opening width defined between the first top edge and the second top edge; and a first drain extending downwardly from the first bottom;

wherein the first top opening width is greater than the first container width and the first top opening is configured to receive liquid into the first container to fill the first container and the first drain is configured to dispense liquid from the first container.

12. The liquid dispenser of claim 11, wherein the first side wall is generally vertical and the second side wall comprises a transition section connected to the second top edge, the transition section extending generally away from the first side wall.

13. The liquid dispenser of claim 11, wherein the first side wall and second side wall are generally vertical and elongated in a vertical dimension and a depth dimension such that a first container height and a first container depth are greater than the first container width.

14. The liquid container of claim 11 further comprising a cover secured over the first top opening.

15. A liquid dispenser comprising:

a first container having a first volume, the first container comprising a first bottom, a first back wall, a first front wall, a first side wall terminating in a first top edge, and a second side wall terminating in a second top edge, a first container width defined between the first side wall and the second side wall, and a first top opening width defined between the first top edge and the second top edge;

a first drain extending downwardly from the first bottom; and a first leg extending downwardly from the first bottom at a location about the first drain;

wherein the first top opening width is greater than the first container width and the first top opening is configured to receive liquid into the first container to fill the first container and the first drain is configured to dispense liquid from the first container.

16. A liquid dispenser comprising:

a first container having a first volume, the first container comprising a first bottom, a first back wall, a first front wall, a first side wall terminating in a first top edge, and a second side wall terminating in a second top edge, a first container width defined between the first side wall and the second side wall, and a first top opening width defined between the first top edge and the second top edge; and a first drain extending downwardly from the first bottom;

a second container having a second volume, the second container comprising a second bottom, a second back wall, a second front wall, a third side wall terminating in a third top edge, and a fourth side wall terminating in a fourth top edge, a second container width defined between the third side wall and the fourth side wall, and a second top opening width defined between the third top edge and the fourth top edge; and a second drain extending downwardly from the second bottom;

wherein the first top opening width is greater than the first container width and the first top opening is configured to receive liquid into the first container to fill the first container and the first drain is configured to dispense liquid from the first container; and wherein the second container width is greater than the first container width, the second top opening width is less than the second container width, and the second top opening is configured to receive liquid into the second container to fill the second container and the second drain is configured to dispense liquid from the second container.

17. The liquid container of claim 16, wherein the first top opening width is substantially equal to the second top opening width.

18. The liquid container of claim 17, wherein the first, second, third, and fourth side walls are generally vertical, the second side wall comprises a first transition section terminating in the second top edge, the first transition section extending generally away from the first side wall, and the third side wall comprises a second transition section terminating in the third top edge, the second transition section extending generally towards the fourth side wall.

* * * * *